US005351588A

United States Patent [19]

Penoza

[11] Patent Number: 5,351,588

[45] Date of Patent: Oct. 4, 1994

[54] HAND SHEAR

[76] Inventor: Frank J. Penoza, 201 Pine Knoll Cir., Hockessin, Del. 19707

[21] Appl. No.: 999,207

[22] Filed: Dec. 31, 1992

[51] Int. Cl.[5] ..... B26B 13/00

[52] U.S. Cl. ..... 83/13; 30/345; 30/350

[58] Field of Search ..... 30/345, 350; 420/436; 425/552; 501/87; 83/13

[56] References Cited

U.S. PATENT DOCUMENTS

| | | | |
|---|---|---|---|
| 2,122,403 | 7/1938 | Balke et al. | 75/136 |
| 2,191,446 | 2/1940 | Balke et al. | 75/136 |
| 2,309,371 | 1/1943 | Wissler | 29/95 |
| 2,377,906 | 6/1945 | Schaaff | 30/345 X |
| 2,579,773 | 12/1951 | Williams | 30/350 |
| 2,801,165 | 7/1957 | Baldwin et al. | 75/134 |
| 3,451,791 | 6/1969 | Meadows | 29/182.8 |
| 3,974,564 | 8/1976 | Hough | 30/350 |
| 4,592,141 | 6/1986 | Levine | 30/350 X |
| 4,868,065 | 9/1989 | Maruyama et al. | 428/547 |
| 4,945,640 | 8/1990 | Garg et al. | 30/350 |
| 4,991,481 | 2/1991 | Gerber | 30/350 X |
| 5,069,872 | 12/1991 | Penoza | 420/436 |

FOREIGN PATENT DOCUMENTS

| | | | |
|---|---|---|---|
| 709740 | 6/1954 | United Kingdom | 30/350 |
| 1231084 | 5/1971 | United Kingdom | C22C 29/00 |

*Primary Examiner*—Rinaldi I. Rada
*Attorney, Agent, or Firm*—Edward J. Newitt

[57] ABSTRACT

An improved, wear-resistant hand shear is provided having a cutting edge which is made of either:

(a) 70% to 84% of tungsten carbide, and 30% to 15.5% of cobalt; or (b) 70% to 97% of tungsten carbide, and 3% to 30% of nickel; or (c) 94% to 99.9% of tungsten carbide and nickel taken together, the ratio of tungsten carbide to nickel being 0.70:0.30 to 0.97:0.03, and 0.1% to 6% of at least one of cobalt, titanium carbide, and tantalum carbide.

8 Claims, 1 Drawing Sheet

HAND SHEAR

BACKGROUND OF THE INVENTION

The present invention relates to a hand shear having one or more cutting edges of an improved wear-resistant composition. More specifically, said wear-resistant composition comprises tungsten carbide modified with selected other materials.

U.S. Pat. No. 3,451,791 and U.K. Pat. No. 1,231,084 disclose ultrafine grained cobalt-bonded tungsten carbide compositions containing 1 to 30 percent by weight of cobalt, some of which are said to be wear resistant, impact resistant, extremely hard and strong. The compositions are disclosed as useful in a wide variety of applications, many of which do not involve cutting; cutting tools are mentioned as a potential utility but no enabling disclosure is provided therefor. Compositions containing 15 to 30 percent cobalt are disclosed as having higher impact resistance and toughness but lower strength than compositions containing less than 15% cobalt. The compositions are said to be suitable for uses where tool steels are normally employed, as in dies and punches.

Conventional means for cutting high-strength fibers or fabrics prepared from said fibers are seriously deficient in wear resistance. Present hand shears are made of low carbon steels or tool steels which are heat-treated to form a hard cutting edge. The cutting edges of such tools quickly become dull and require frequent regrinding which significantly reduces the hardness and durability of the cutting edge.

The art also discloses hand shears made of zirconium oxide. These shears are very brittle and susceptible to chipping during edge grinding, and are known to shatter into fragments if dropped on a hard surface.

Another known shear consists of a mechanically held, throw-away insert attached to a holder, said insert forming the cutting edge. Misalignment common in such a device results in poor cutting.

While the above-described shears are capable of cutting many low-strength materials, they fail to provide precise blade alignment and blade edge continuity required to cut high-strength fibers such as aromatic polyamide fibers, glass and carbon and are therefore difficult and uneconomical to use for such high-strength fibers.

Some prior art cutting devices employ a relatively low carbon steel that quickly loses hardness during regrinding. Other art devices employ a hard, brittle ceramic that is difficult to grind. Moreover, the cutting edges achieved in these devices fail to furnish the sharpness and durability required to sever high-strength fibers and fabrics such as those mentioned above.

Conventional hand shears are typically manufactured using old manufacturing methods which result in high cost and poor product quality.

An object of the present invention is a cutting tool, particularly a hand shear, having a cutting edge of unusually low coefficient of friction which is superior to conventional cutting tools in edge wear resistance, hardness and/or toughness, and which is economically feasible for commercial manufacture. Additional objects include cutting tools wherein the cutting edges have chemical compositions which provide greater toughness or greater hardness, or a combination thereof, relative to prior art devices; and cutting devices which are capable of efficiently cutting high-strength fibers and fabrics prepared from said fibers.

Commonly owned U.S. Pat. 5,069,872, which is hereby incorporated by reference herein, discloses several cutting edge compositions which provide superior wear resistance and hardness. Included is the composition consisting essentially of 85% to 96% tungsten carbide and 15% to 4% cobalt. The patent discloses that tungsten carbide/cobalt compositions containing between 6% and about 13% cobalt have relatively good strength and wear-resistance. It is further disclosed that compositions containing between 13% and 25% cobalt show reduced wear-resistance, and it is concluded therein that there is no significant advantage in using tungsten carbide/cobalt compositions containing more than about 13% cobalt.

SUMMARY OF THE INVENTION

A wear-resistant hand shear is provided having at least one cutting edge made of the composition consisting essentially of: (a) 70% to 84.5% by weight of tungsten carbide, and 30% to 15.5% by weight of cobalt; or (b) 70% to 97% by weight of tungsten carbide and 3% to 95% by weight of nickel; or (c) 94% to 99.9% by weight of tungsten carbide and nickel wherein the weight ratio of tungsten carbide to nickel is in the range of 70/30 to 97/3, and 0.1% to 6% by weight of at least one ingredient selected from cobalt, titanium carbide and tantalum carbide; or (d) 94% to 99.9% by weight of tungsten carbide and cobalt wherein the weight ratio of tungsten carbide to cobalt is in the range of 70/30 to 84.5/15.5, and 0.1% to 6% by weight of one or both of titanium carbide or tantalum carbide.

Also provided is a method of cutting with the improved hand shear of the invention.

DETAILED DESCRIPTION OF THE INVENTION

Figure 1:
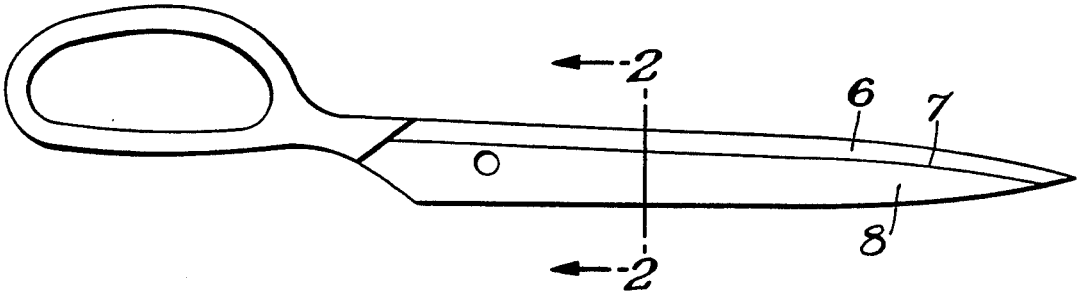
FIG. 1 is a schematic diagram of one component of a hand shear of the invention having at least one cutting edge manufactured of composition (a), (b), (c) or (d) described hereinabove.

The hand shear of the invention has at least one cutting edge made of an improved wear-resistant composition consisting essentially of:

(a) 70% to 84.5% by weight of tungsten carbide and 30% to 15.5% by weight of cobalt; or (b) 70% to 97% by weight of tungsten carbide and 3% to 30% by weight of nickel; or (c) 94 to 99.9% by weight of tungsten carbide and nickel wherein the weight ratio of tungsten carbide to nickel is in the range of 70/30 to 97/3, and 0.1% to 6% by weight of at least one ingredient selected from cobalt, titanium carbide and tantalum carbide; or (d) 94% to 99.9% by weight of tungsten carbide and cobalt wherein the weight ratio of tungsten carbide to cobalt is in the range of 70/30 to 84.5/15.5, and 0.1% to 6% by weight of one or both of titanium carbide or tantalum carbide.

Preferably, composition (a) consists essentially of 75% to 84.5% by weight of tungsten carbide and 25% to 15.5% by weight of cobalt. Preferably, in composition (c), about 1% to 6% by weight of cobalt, titanium carbide and tantalum carbide are present. Preferably, in composition (d), about 1% to 6% by weight of titanium carbide and tantalum carbide are present.

According to the present invention, these compositions may be attached to the edge of a cutting tool such as hand shears by cementing or brazing to form a cutting edge having superior properties including wear resistance, hardness and a low coefficient of friction.

Tungsten carbide provides a hard wear-resistant surface, while cobalt or nickel provide wetting and bonding of the tungsten carbide particles to form the required wear-resistant cutting edge composition. Small amounts of titanium carbide and/or tantalum carbide effectively reduce coefficient of friction.

Small percentages of other elements, such as iron, silicon or molybdenum, may be included adventiously, but are only incidental to the manufacture of the cutting edge compositions and are not thought to contribute to the performance thereof.

The cutting edge compositions used in the manufacture of the hand shears of the invention are prepared from commercially available components. In some cases the complete compositions used to prepare the cutting edges of the invention are available commercially from the family of materials known in the art as "cemented tungsten carbides". Although available commercially, however, these materials were heretofor used only for different purposes.

The cutting edges prepared from the compositions herein described have superior wear-resistance, hardness, quality of cut and, in some cases, lower coefficient of friction than those previously available in the art. Cutting tools such as hand shears, knives and the like containing these cutting edges are measurably superior to conventional commercially manufactured cutting tools in durability and cutting quality. Hand shears having at least one of said cutting edges are especially effective for cutting high strength fibers, such as, but by no means limited to, Kevlar® Aromatic Polyamide fibers, carbon fibers and glass fibers. Moreover, the present cutting edge compositions are easy to control, thus permitting manufacture of high quality cutting tools such as hand shears.

In a hand shear according to the present invention, the cutting edge wears primarily by abrasive flattening of individual particles. It will be readily appreciated that, in such cutting edges, the thousands of particles are being used to their fullest extent because the cobalt and/or nickel bonding agent is sufficiently strong to hold the particles in place and permit maximum utilization of the hard particles.

Actual comparisons to date of conventional hand shears and those whose cutting edges are prepared according to the present invention indicate that the latter have a useful life span of 40 to 60 times greater than conventional hand shears subjected to substantially equivalent use conditions.

The compositions of the present invention are generally prepared by conventional methods.

Cemented tungsten carbide is made by powder metal processing, the principal stages in the manufacture of which include: (1) production of tungsten metal powder; (2) preparation of tungsten carbide; (3) addition of cobalt or nickel to produce grade powder; (4) pressing; (5) pre-sintering; and (6) final sintering. Optionally, in step (3) an mount up to but not exceeding 6% by weight of either or both titanium carbide or tantalum carbide may also be introduced; and, when nickel rather than cobalt is added in step (3), the up to 6% of optional materials may also include cobalt.

Tungsten oxide is reduced in hydrogen at a temperature of about 2000° F. to form tungsten metal powder which is relatively soft. Carbon or lamp black is added to the tungsten powder and this mixture is carburized in an induction furnace at approximately 2800° F. to form tungsten carbide powder.

Cobalt or nickel oxides are reduced in hydrogen at approximately 1800° F. to produce cobalt or nickel powder.

Titanium oxide or tantalum oxide is mixed with carbon or Imp black and reduced and carburized in an induction furnace at approximately 3200° F. to produce titanium or tantalum carbide powder.

The above are the primary materials used to produce cemented tungsten carbide.

Selected powders are placed in a ball mill containing acetone. The mill is lined with cemented tungsten carbide and also contains cemented tungsten carbide balls. The powders are crushed by the grinding action of the balls to produce a powder having a size range of 1–5 micrometers.

After ball milling for 3–5 days, the powder slurry is placed in trays and thoroughly dried. The powder is then screened and sifted through a series of fine metal screens to remove foreign matter and oversize lumps.

Powders selected to produce a specific grade of cemented carbide are placed in a blender and thoroughly mixed to obtain maximum strength and grade uniformity.

At this point in the process, the powders are ready for either hot pressing or cold pressing to form a final shape. Hot pressing is used primarily for the manufacture of larger carbide parts, and cold pressing is used for a variety of smaller parts.

In preparation for cold pressing, the dried powder is fed through a hammer mill and wax is added to the powder during the milling operation. The powder/wax mix is placed in an open-ended tumbling machine and tumbled until small spheres are formed. The spheres, slightly larger than grains of salt, are then used to fill the mold cavity for the cold pressing operation. The purpose of forming the spheres is to allow the mold cavity to fill evenly and equalize the powder density throughout the mold.

The pressed blanks are fed through a hydrogen-containing furnace at approximately 2000° F. and the wax is removed from the pressed blank. At this stage, the blanks have the strength of chalk and can be machined to form angles, holes, etc. as required in the final blank design.

The blank is placed in a vacuum or hydrogen-containing furnace and heated to approximately 2800° F. During this operation, the blanks assume their final size and hardness while shrinking from 20% to 30% of their original volume.

The hard metal blanks generally have a hardness ranging from 84 Rockwell A to 92.8 Rockwell A, depending on the size of the carbide particles and the percentage of cobalt or nickel binder used during the sintering operation.

The blank can be used in the sintered state or machined by diamond grinding to form a desired surface finish. In order for the small carbide blank to be used effectively, it may be attached to a larger or heavier backing material such as a steel shank.

Blanks may be secured to a steel shank by methods such as brazing, cementing or mechanical fastening. The blade alignment necessary in this invention requires the carbide edges to be secured by brazing or cementing.

Brazing is a commonly used method of securing carbide inserts to steel, and is readily accomplished by the following steps: (1) clean both mating surfaces; (2) coat each mating surface with Handy Flux (Handy & Harmon Co.); (3) position brazing shim approximately 0.003 inch thick between mating surfaces; and (4) apply heat by hand torch or induction coil.

A common brazing alloy designated BAg3 has a brazing temperature in the range of 1270° to 1550° F. with a solidus temperature of 1170° F. The total braze thickness generally is 0.0015 inch to 0.0025 inch which gives a shear strength of 70,000 to 100,000 psi.

Adhesives or cements may also be used to secure carbide to a shank material, especially where operating temperatures and bond strength requirements are low. A common adhesive is a two-part epoxy resin cement which sets firmly in a few minutes at room temperature.

Hard, cemented tungsten carbide may be machined by conventional techniques such as use of a diamond wheel. Excellent surface finish and sharp edges can be produced on cemented carbide through suitable wheel selection. Wheels are selected according to wheel diameter, diamond mesh size, diamond concentration, bonding material, wheel speed, depth of cut, and use of sufficient coolant or no coolant. Such selection parameters will be well known to those skilled in the art.

The 8 to 10 AA surface finish required to produce the sharp cutting edge according to this invention is obtained by rough grinding with a 100-mesh resinold diamond wheel and finish grinding with a 220-mesh resinold diamond wheel. Use of a flood of coolant to minimize heat buildup during the rough and finish grinding is beneficial but not essential.

Depth of cut or down feed using the 100-mesh diamond wheel should be 0.001 inch per cycle until the surface is dean. The final surface finish is generated with the 220-mesh diamond wheel using 0.001 inch depth of cut until the last 5 or 6 cycles when use of 0.0005 inch depth of cut generates the final surface finish of 8 to 10 AA.

The cutting edge according to this invention, as shown in FIG. 1, must be a smooth, continuous line having no flaws along the edge. Relief angles of 0° to 65° included have been evaluated; depending on the material being cut, these relief angles should be modified to prevent edge damage.

Figure 2:
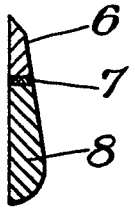
FIG. 2 is a cross-sectional view along line 2—2 of FIG. 1.

FIG. 1 shows one component of a set of hand shears made according to the invention. FIG. 2 is a cross-section taken along line 2—2 of FIG. 1 wherein edge 6 is affixed to shear component 8 by brazing or cementing 7.

The following examples are intended to illustrate the invention but not in any way limit its scope as claimed below. Cutting performance of a hand shear is determined by the number of effective cuts of a given fiber completed with said shear before at least part of the cutting edge fails to cut the fiber.

All percentages are expressed on a weight percent basis unless otherwise indicated.

EXAMPLE 1

A cutting edge composition was prepared according to the above procedures containing 94% tungsten carbide and 6% nickel. The specimens were affixed to shear handles by brazing and then finished by grinding to form the required cutting edge. The shears were used to cut yarns and fabric of Kevlar ® aromatic polyamide fiber, fiberglass and graphite. The shears cut these materials very satisfactorily, outperforming at least a 40-fold conventional shears having cutting edges fabricated of low carbon steel or tool steel.

EXAMPLE 2

A cutting edge composition was prepared as in Example 1 containing 87% tungsten carbide and 13% nickel. The specimens were affixed to shear handles by brazing and then finished by grinding to form the required cutting edge. The shears were used to cut yarns and fabric of Kevlar ® aromatic polyamide fiber, fiberglass and graphite. The shears cut these materials very satisfactorily, outperforming at least a 40-fold conventional shears having cutting edges fabricated of low carbon steel or tool steel.

EXAMPLE 3

A cutting edge composition was prepared as in Example 1 containing 75% tungsten carbide and 25% cobalt. The specimens were affixed to shear handles by brazing and then finished by grinding to form the required cutting edge. The shears were used to cut yarns and fabric of Kevlar ® aromatic polyarnide fiber, fiberglass and graphite. The shears cut these materials very satisfactorily, outperforming at least a 40-fold conventional shears having cutting edges fabricated of low carbon steel or tool steel.

Although certain specific embodiments and descriptive details of the invention have been disclosed herein, it will be apparent to those skilled in the art that modifications or variations of such details can readfly be made, and such modifications or variations are considered to be within the scope of this invention as claimed hereinbelow.

I claim:

1. An improved, wear-resistant hand shear having at least one cutting edge made of the composition consisting essentially of 70% to 97% by weight of tungsten carbide, and 3% to 30% by weight of nickel; or 94% to 99.9% by weight of tungsten carbide and nickel taken together, the ratio of tungsten carbide to nickel being in the range of 0.70 : 0.30 to 0.97 : 0.03, and 0.1% to 6% by weight of an ingredient selected from the group consisting of cobalt, titanium carbide, tantalum carbide and mixtures thereof.

2. The hand shear according to claim 1 wherein the cutting edge composition is 70% to 97% by weight of tungsten carbide, and 3% to 30% by weight of nickel.

3. The hand shear according to claim 1 wherein the cutting edge composition is 94% to 99.9% by weight of tungsten carbide and nickel taken together, the ratio of tungsten carbide to nickel being in the range of 0.70 : 0.30 to 0.97 : 0.03, and 0.1% to 6% by weight of an ingredient selected from the group consisting of cobalt, titanium carbide, tantalum carbide and mixtures thereof.

4. The hand shear according to claim 3 wherein the cutting edge composition consists essentially of 94% to 99.0% by weight of tungsten carbide and nickel taken together, the ratio of tungsten carbide to nickel being in the range of 0.70 : 0.30 to 0.845 : 0.155, and 1% to 6% by weight of an ingredient selected from the group consisting of cobalt, titanium carbide, tantalum carbide and mixtures thereof.

5. The method of cutting a material with a wear resistant hand shear having at least one cutting edge made of the composition consisting essentially of 70% to 97% by weight of tungsten carbide and 3% to 30% by weight of nickel; or 94% to 99.9% by weight of tungsten carbide and nickel taken together, the ratio of tungsten carbide to nickel being in the range of 0.70 : 0.30 to 0.97 : 0.03, and 0.1% to 6% by weight of an ingredient selected from the group consisting of cobalt, titanium carbide, tantalum carbide and mixtures thereof.

6. The method according to claim 5 wherein the material is a high strength fiber.

7. The method according to claim 6 wherein the high strength fiber is selected from the group consisting of aromatic polyamide fiber, glass fiber and carbon fiber.

8. In a method of cutting with a hand shear, the improvement comprising said hand shear having at least one cutting edge made of the composition consisting essentially of:

70% to 97% by weight of tungsten carbide and 3% to 30% by weight of nickel; or

94% to 99.9% by weight of tungsten carbide and nickel taken together, the ratio of tungsten carbide to nickel being in the range of 0.70 : 0.30 to 0.97 : 0.03, and 0.1% to 6% by weight of an ingredient selected from the group consisting of cobalt, titanium carbide, tantalum carbide and mixtures thereof.

* * * * *